US007412755B2

(12) United States Patent
Tetu et al.

(10) Patent No.: US 7,412,755 B2
(45) Date of Patent: Aug. 19, 2008

(54) BRACELET PROVIDED WITH A CLASP

(75) Inventors: Guillaume Tetu, Neuchatel (CH); Francois Burgener, Auvernier (CH)

(73) Assignee: Tag-Heuer SA, Marin (CH)

( * ) Notice: Subject to any disclaimer, the term of this patent is extended or adjusted under 35 U.S.C. 154(b) by 0 days.

(21) Appl. No.: 10/792,969

(22) Filed: Mar. 4, 2004

(65) Prior Publication Data

US 2004/0168469 A1 Sep. 2, 2004

Related U.S. Application Data

(63) Continuation of application No. PCT/CH02/00455, filed on Aug. 21, 2002.

(51) Int. Cl.
*A44C 5/18* (2006.01)

(52) U.S. Cl. ..... 24/71 J; 24/68 J; 24/265 WS

(58) Field of Classification Search ..... 63/3.1, 63/3, 3.2, 7, 9, 10, 21, 35, 38; 24/71 J, 71 R, 24/68 J, 265 WS, 70 J
See application file for complete search history.

(56) References Cited

U.S. PATENT DOCUMENTS

| | | | | |
|---|---|---|---|---|
| 4,330,905 | A * | 5/1982 | Wolfgang | 24/71 J |
| 4,928,359 | A * | 5/1990 | Gagnebin | 24/71 J |
| 5,305,503 | A * | 4/1994 | Yamagata | 24/68 J |
| 5,749,128 | A * | 5/1998 | Cuche | 24/71 J |
| 5,787,554 | A * | 8/1998 | Hashimoto | 24/68 J |
| 2004/0083581 | A1* | 5/2004 | Kawagoe | 24/265 WS |

FOREIGN PATENT DOCUMENTS

| | | | |
|---|---|---|---|
| DE | 35 20 122 | | 1/1986 |
| EP | 0 461 675 | | 12/1991 |
| EP | 0 904 709 | | 3/1999 |
| EP | 0 913 106 | | 5/1999 |
| JP | 3-101211 | | 10/1991 |
| JP | 4-40811 | | 4/1992 |
| JP | 09-191910 | | 7/1997 |
| JP | 2000-106920 | | 4/2000 |
| JP | 2000-201710 | | 7/2000 |
| WO | WO 9423340 | A1 * | 10/1994 |
| WO | WO 98 30123 | | 7/1998 |
| WO | WO 3009729 | A1 * | 2/2003 |

OTHER PUBLICATIONS

English translation of First Office Action of counterpart foreign application: Japanese Patent Application No. 2003-526227, mailing date Jun. 19, 2007.

* cited by examiner

*Primary Examiner*—Jack W. Lavinder
(74) *Attorney, Agent, or Firm*—Pearne & Gordon LLP

(57) ABSTRACT

Bracelet provided with a foldable clasp, comprising a first arm (7), at least a second arm (8) articulated with said first arm, a cover (4, 6), under which the arms' free extremities are folded back when the clasp is closed. The cover comprises a locking system enabling the arms to be held in a closed position and to be released by acting manually on the locking system to open the clasp. It further comprises a casing (4) and a base (6) closing the cover's lower side. The casing comprises solid sides of uneven thickness obtained by detach cutting machining or by molding. The casing's sides define between them and with the base an internal volume (45; 95) in which the locking system is at least partially accommodated.

17 Claims, 4 Drawing Sheets

BRACELET PROVIDED WITH A CLASP

This application is a continuation of application PCT/CH02/00455 (WO03/022090), filed on Aug. 21, 2002, claiming priority of application 2001CH-1668 of Sep. 1, 2001, the contents of which are hereby incorporated by reference.

FIELD OF THE INVENTION

The present invention concerns a bracelet provided with a clasp, in particular a bracelet provided with a foldable clasp.

RELATED ART

Different types of foldable clasps have already been proposed notably for watch bracelets. They often comprise two or sometimes three articulated arms that fold in closed position under a cover. One of the arms, or sometimes the cover, comprises a locking system enabling the arms to be held in folded position.

An example of such a clasp is described for example in CH-A5-668353. In this document, the cover's locking system comprises two push-pieces provided with hooks that lock against the arms' edges in order to hold them in closed position under the push-pieces' spring load. The clasp can be opened by pressing on the push-pieces against the spring load so as to free said hooks. The locking system is entirely contained under the cover with the exception of the push-pieces' heads, which protrude.

The clasp cover is formed of a simple plate folded on two sides. Although this process is cost-effective, it does not allow for a clasp with an attractive appearance. In particular, it is not possible to obtain a clasp with such a solid appearance and with the same surface treatment as the bracelet's other metallic links, which are generally obtained by machining so as to give them an aesthetic "sculpted" and smooth appearance. Furthermore, the cover's lower side comprises many concave portions in which the closing mechanism is clearly visible. This part is very difficult to clean and moreover risks malfunctioning when it is exposed to transpiration and skin debris from the wearer. Furthermore, hairs and even bits of skin more often than not get pinched under the clasp, making the clasp uncomfortable.

A clasp showing the same inconveniences is described for example in document EP-A1-0908112 and in document EP-A1-0914781. In the latter case, one of the clasp's two arms is constituted by two juxtaposed arms. The closing mechanism makes use of the natural tendency of the two arms to elastically move apart from one another. The clasp can be opened by moving the two arms towards one another by acting on two push-pieces provided to this effect. The lock's safety however depends on the elastic force moving the arms apart, which tends to diminish with time.

In the devices described in the aforementioned documents, one of the bracelet's portions is fastened inside the cover, between the two folded edges. The clasp is thus necessarily wider and thicker than the corresponding bracelet's portion, which in most bracelets proves unaesthetic or an additional aesthetic constraint. In particular, this type of construction does not make it possible to give a continuous appearance to the links-clasp ensemble.

It is therefore an aim of the present invention to propose a bracelet provided with a foldable clasp that avoids the disadvantages of the prior art.

BRIEF SUMMARY OF THE INVENTION

According to the invention, these aims are achieved by means of a bracelet having the characteristics of the independent claim, preferred embodiments being furthermore specified in the dependent claims.

In particular, these aims are achieved by means of a bracelet clasp comprising a first arm, at least a second arm articulated with the first, a cover, the free extremity of the first arm being articulated with the bracelet said first portion, the free extremity of the second arm being articulated with said cover, said cover being connected to the bracelet's second portion, the cover comprising a locking system enabling the first and second arms to be held in closed position and to be released by acting manually on the locking system to open the clasp, and wherein the cover comprises a casing and a base closing the cover. The casing comprises solid sides of uneven thickness obtained for example by machining, by molding and/or stamping (swaging) with varying stamping depths. The arms' width is inferior or equal to the cover's width, so that the arms' free extremities are folded and hidden under the cover when the clasp is closed. The casing's sides define between them and with the base an internal volume in which the locking system is at least partially accommodated.

These characteristics have notably the advantage of making it possible to give the bracelet's clasp an external appearance very close to that of the bracelet's other links. In particular, it is possible to machine, mold and/or stamp the clasp so that the profile of its lateral sides is the same as the profile of said links' lateral sides. The casing's width and surface conditioning are furthermore preferably the same as those of the bracelet's link rows. These characteristics, which cannot easily be obtained from a cover formed by folding a plate having a constant thickness, allow a bracelet-clasp ensemble to be obtained that has an extremely pleasing uniform and compact appearance.

Furthermore, the protecting base closing the lower side of the cover's casing enables the clasp's locking system to be effectively protected and prevents it from getting jammed because of deposits of dust or debris. The casing-base ensemble can be devoid of edges or square angles, making it less easily soiled and more comfortable to wear. In a preferred embodiment, the base is made of a simple and cheap plate whereas the casing, which determines the cover's outer shape, has a more solid appearance obtained by machining, by molding or by stamping. The base can possibly be done without when the cover's thickness must be reduced, for example in the case of a leather bracelet.

According to another advantage of the invention, it is possible to fasten said cover directly with an ordinary link row of the bracelet. It is thus not necessary to modify the links closest to the cover; the fastening system with the cover is the same as, or is at least compatible with, the system used to assemble the link rows together.

DESCRIPTION OF THE DRAWINGS

Other advantages of the present invention will become apparent upon reading the description given by way of example and illustrated by the attached drawings containing the figures, in which.

DETAILED DESCRIPTION OF THE INVENTION

Figure 1:
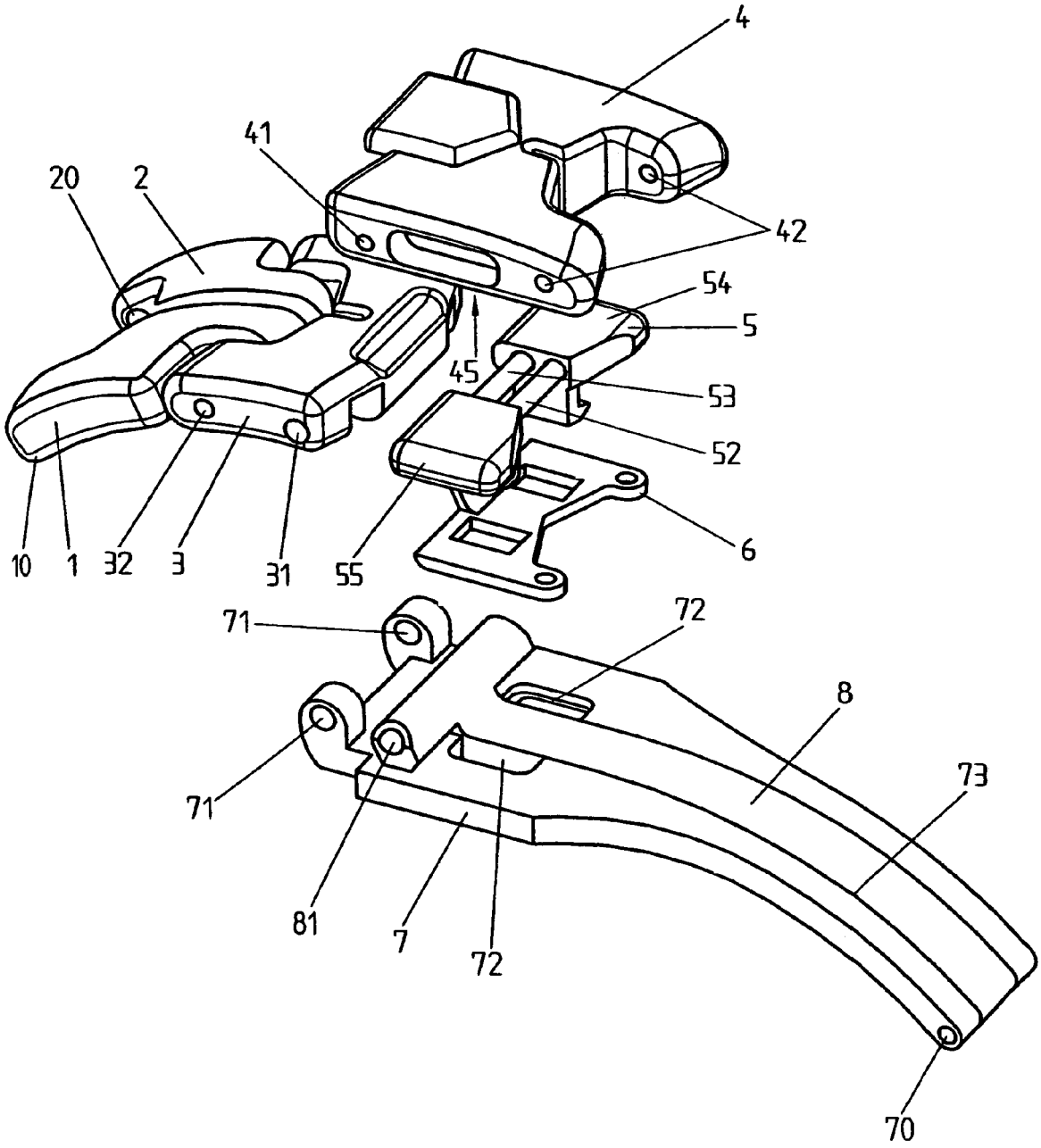
FIG. 1 shows a perspective exploded view of a bracelet clasp according to the invention.

FIG. 1 shows an example of a clasp according to the invention. This clasp is designed for example to be used to close a watch bracelet of the type described in patent application WO0065948. A single row formed of two links 1, 2 of one of the bracelet's portions is represented in the Figure. In this example, each row is constituted of a right link 1 and of a symmetrical left link 2. The invention is however not restricted to bracelets comprising two links per row; it would be possible for example to insert one or several intermediary links between the marginal links 1 and 2. Similarly, the invention is not limited to the particular illustrated shape of the links. It is furthermore also possible to use the inventive clasp with non-metallic bracelets, for example with leather or rubber bracelets. The clasp itself is preferably made of metal, but could also be of synthetic or composite material.

The links 1 and 2 of each row are held against each other between a portion of the links of the next row. A cylindrical rod (not shown) traverses all the links of each row through an opening having a diameter slightly superior to that of the rod, so as to allow a rotation without play of the rows of links in relation to each other. The rod is received in an opening 20 in the link 2 and a corresponding opening (not shown) in the link 1.

The clasp comprises a first arm 7 and a second arm 8 connected to one another in an articulated manner by means of an axis 70. The arms can be of steel or of precious metal; it is however also possible to use flexible arms, for example rubber or synthetic arms having a bending radius adapted to the wearer's wrist. The first arm 7 comprises two arms separated by a slit 73 in which the second arm 8 is accommodated in folded position, so that the two folded arms occupy only a single thickness. The first arm 7 is connected in an articulated fashion around a rod 31 with a connecting piece 3 to the bracelet's first portion and traverses openings 71 in the horns integral with the first arm 7. The shape of the connecting piece 3 enables the two links 1, 2 of the first row to be held together and to articulate them around a rod 32. The rod 31 is preferably visible and accessible from the flanks of the connecting piece 3; it is thus possible to drive it out by means of an appropriate tool to remove the links 1 and 2 and thus modify the bracelet's length. In a variant embodiment, it is also possible to forgo the intermediary piece 3 and to connect the first links 1, 2 directly with the first arm 7 whose shape will be adapted accordingly.

The second arm 8 is connected with the clasp's cover, which comprises a casing 4 and a base 6 removably fastened to one another, around an axis 81 traversing the openings 41. According to the invention, the openings 41 are located in a plane between the plane of the base 6 and the upper side of the base; in this manner, the connection between the casing 4 and the second arm 8 does not increase the cover's overall thickness. Furthermore, the risk of the skin or hairs being pinched at the articulation is minimized. The openings 41 are furthermore provided on the cover's side opposite the bracelet's second portion (on the left in the Figure) so as to increase the length of the second arm 8 and the bracelet's outspread range. When the clasp is opened, this construction furthermore allows the cover to be held naturally in a plane between the plane of the second arm 8 and the plane of the bracelet's second portion, thus facilitating the handling of the cover that will not risk swinging in a vertical position perpendicular to the bracelet.

A scalloping in the casing 4 enables a row of two links of the bracelet's second portion (not represented) to be fastened there directly. The shape of the scalloping corresponds to the shape of the scalloping formed between two juxtaposed metallic links of each row of the bracelet; it is thus possible to fasten any ordinary links directly to the cover. The links are connected in an articulated fashion by means of a rod 42*a* in openings 42 and held between the casing's two parallel sides 47. The rod 42*a* can preferably also be removed to take off or add rows of links in order to modify the bracelet's length. All the axes enabling the cover to be fastened to the clasp by a rod 41*a* and to the bracelet traverse the openings 41, 42 through the solid casing 4, thus avoiding stress on the less rigid base 6.

The base 6 makes it possible to close the lower side of the casing 4 whilst leaving an empty volume 45 for accommodating the locking system 5. This locking system enables the casing to be held in folded position over the first arm 7. The base 6 is provided with two slits 60 traversed by hooks 500 510 (visible in FIG. 3) acting as holding means to hook themselves in closed position with the first arm 7 by traversing the openings 72 provided to this effect. The hooks are guided between the holding position and the released position by the edges of the slits 60. The clasp can be opened by pressing simultaneously on the two push-pieces 54, 55 protruding on each side of the casing 4 through the lateral openings 40, so as to move the hooks closer to one another to disengage them from the openings 72. It is impossible to open the clasp by acting on a single push-piece. The hooks 500, 510 are directly connected to the push-pieces 54, 55; the user thus directly senses the range of the movement effected by the hooks, which allows him to perfectly feel the button's action and the moment when the unhooking is accomplished. The openings 40 traversing the lateral sides 46, 48 with bevels 49 of the casing 4 enable the locking system 5 to be held even when the base 6 is unscrewed, thus making easier the cover's disassembly, for example for cleaning.

The openings 72 make it possible to fasten the cover's hooks 500, 510 on each side of the second arm 8 rather than in its extension. These fastening means thus do not restrict the maximal length of the second arm, which is nearly as long as the first arm 7. This characteristic allows the outspread range of a clasp of given length to be maximized.

Figure 2:
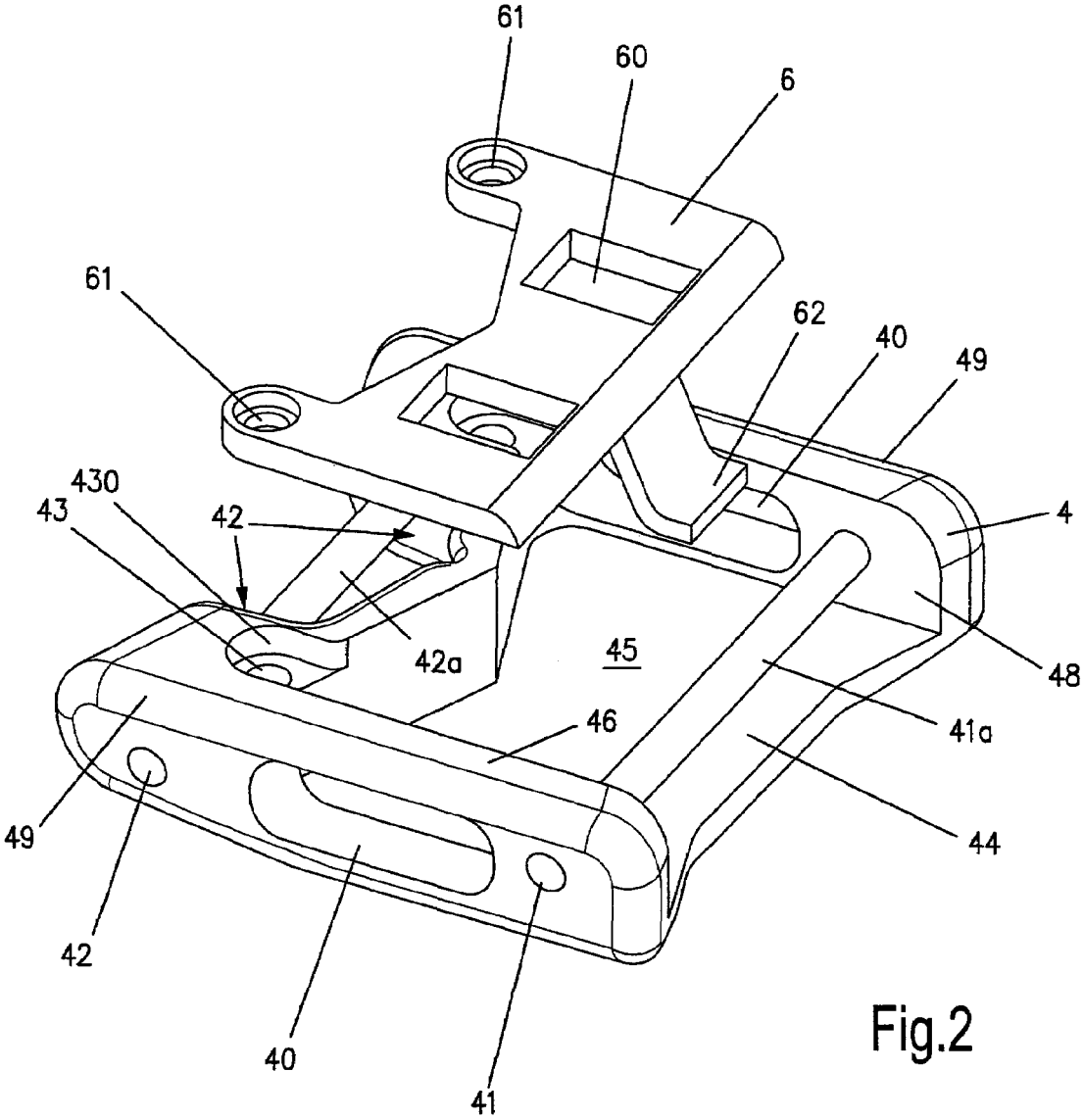
FIG. 2 shows a perspective exploded view from below of a first embodiment of the clasp cover according to the invention.
Figure 3:
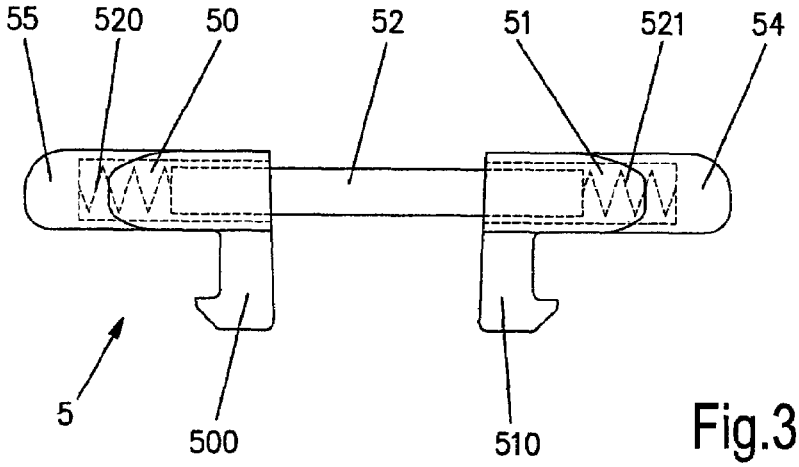
FIG. 3 shows a lateral view of the locking system of the inventive clasp.

A first embodiment of the cover is represented in FIGS. 2 and 3. In this example, the cover is constituted by the casing 4 and the base 6 screwed onto the casing 4 by means of two screws through holes 61 engaged in threads 43 and preferably stopped by a point of glue. The screws are visible only on the cover's lower side. When the clasp is folded, i.e. when the bracelet is worn, its external appearance is determined exclusively by the casing 4 whereas the base 6 and the screws are hidden between the casing 4 and the arms 7, 8. The casing's external appearance is thus better crafted than that of the base 6. In this example, the casing 4 has a solid appearance and is preferably manufactured by detach cutting machining, by molding and/or stamping with varying stamping depths, i.e. preferably with the same method as that used for manufacturing the bracelet's links 1, 2. Stamping with varying stamping depths means here a stamping method with a stamp or die comprising a non-plane resting surface with the piece to stamp.

It is thus possible to make a casing comprising solid sides 44, 46, 48 of uneven thickness and whose profile of its lateral sides is preferably the same as the profile of the lateral sides of the bracelets' links 1, 2.

The same surface conditioning will also preferably be applied to the casing 4 as to the links 1, 2. Finally, in a preferred embodiment, the width of the casing is equal to that of the bracelet's link rows. The width of the arms 7 and 8 is preferably less than that of the cover and links, so that they are hidden under the bracelet and the cover. It is thus possible to obtain a homogenous bracelet-clasp ensemble that is very aesthetic and comfortable, which could not be realized if the casing were manufactured by plate folding or by a manufacturing process different from that used for the links.

The base 6, which is more often than not hidden, can be manufactured with a cheaper method, in this example by folding and stamping of a plate having an even thickness. It is accommodated in a shoulder 430 in the casing 4 so as to avoid any edges that might hurt/injure or irritate the wearer of the watch. The casing-base ensemble is thus practically devoid of any projection and presents a compact external appearance. The external side of the base 6 is plane and rests with its whole length against the arms 7, 8 of the folded clasp, so that no dirt deposits can accumulate under the cover. The upper side of the casing 4 is however preferably arched in the direction of the bracelet's curve. The cover is devoid of any abrupt angles or concave portions, making it less easily soiled. Finally, the base 6 enables the locking system 5 to be effectively protected against dust or debris and prevents it from getting jammed.

The base 6 is provided in this example with a tongue/tab 62 preventing the base from becoming disunited from the casing 4 when the clasp is in closed position, even if the screws in the holes 61 should accidentally become totally unscrewed.

FIG. 3 shows the detail of the locking system 5 of the cover in closed position. It comprises in this example two push-pieces 54, 55 provided each with two recesses 51, 50. The two extremities of two extensible rods 52, 53 are lodged in the two recesses 51, 50 of the two push-pieces. The extensible rods 52, 53 are in this example constituted by a middle metallic rod and by an elastic spring 520, 521 lodged at the bottom of each recess, on both extremities of the rods. It would however also be possible, in a variant embodiment, to put only a single spring at one of the two extremities of the two rods 52, 53 or, in another variant embodiment (not illustrated) to use bars constituted of two hollow half-rods inside of which an elastic spring is lodged that tends to move these rods apart.

The use of two parallel rods 52, 53 ensures that the push-pieces 54, 55 move without swiveling when they are actuated. In a variant embodiment that is more economical or adapted to smaller clasps, it would however be possible to use a single rod instead of two, for example an extensible rod of non cylindrical shape. It is also possible, though not recommended, to use a single push-piece acting on a single hook rather than a locking system having two push-pieces.

Figure 4:
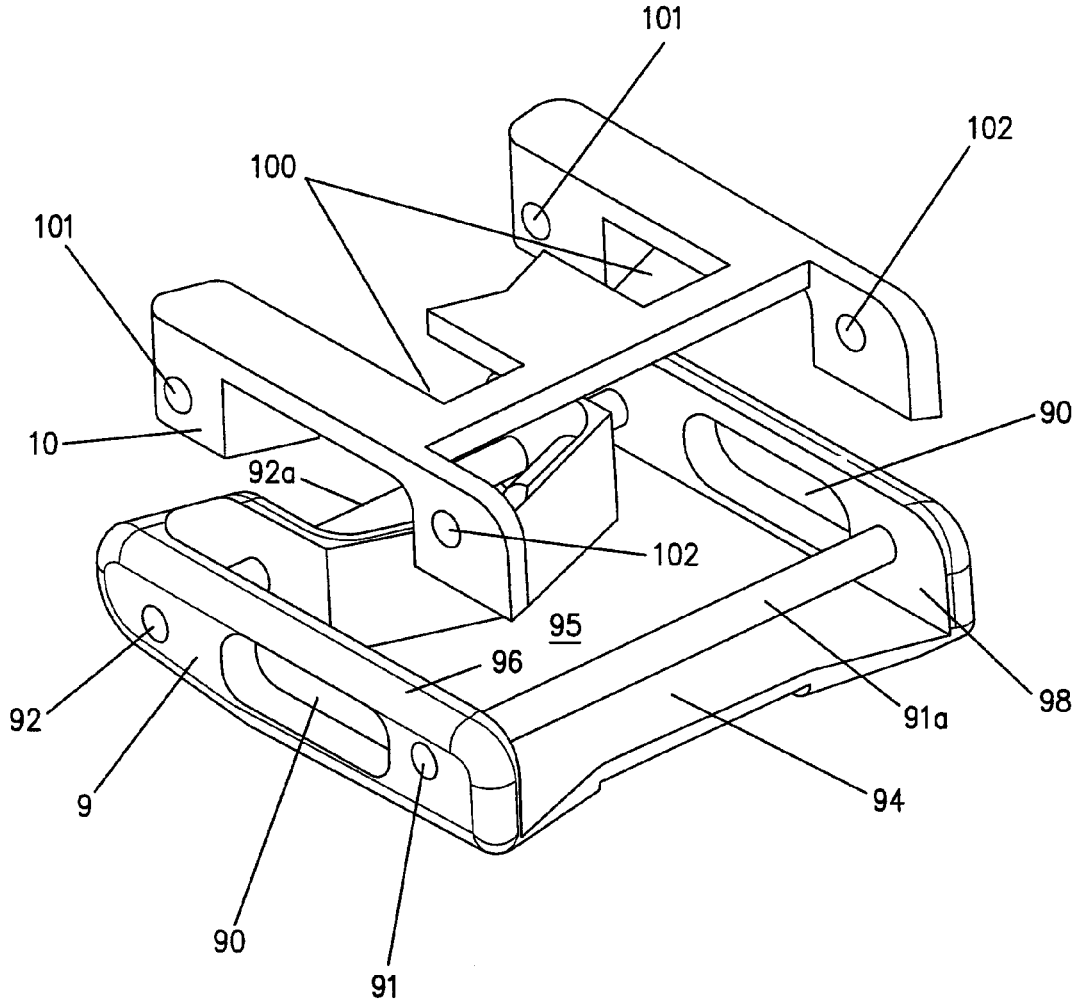
FIG. 4 shows a perspective exploded view from below of a second embodiment of the clasp cover according to the invention.
Figure 5:
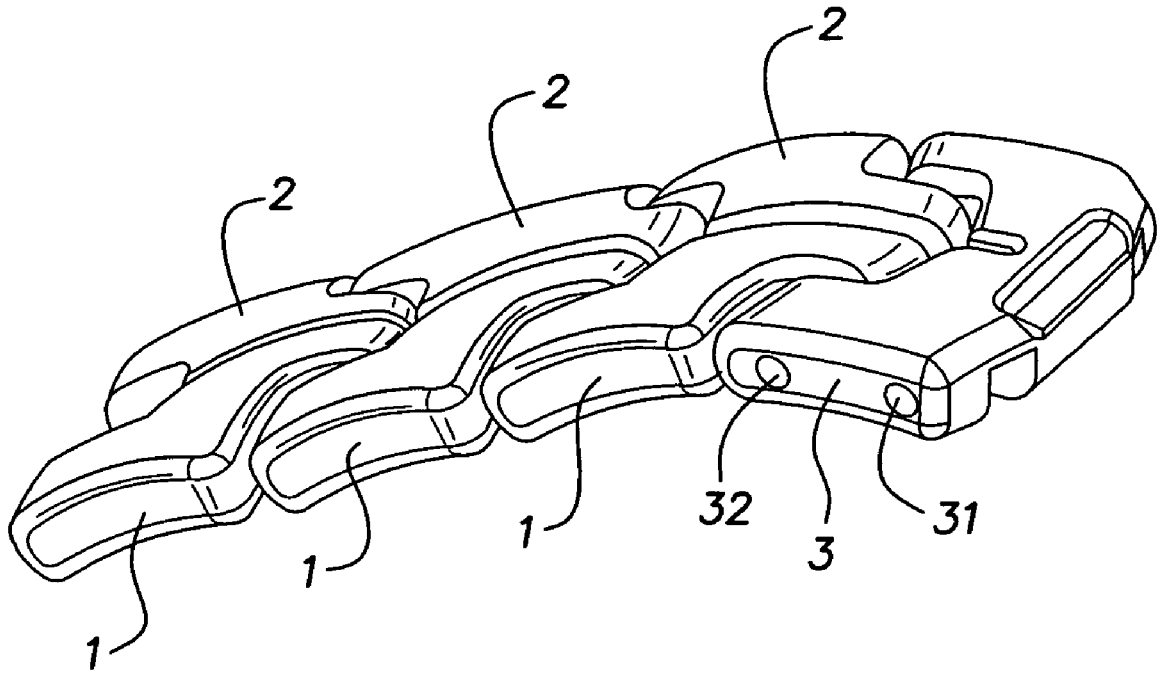
FIG. 5 shows a perspective view of a portion of the bracelet illustrating several links in each row.

FIG. 4 illustrates a variant embodiment of the cover according to the invention. In this embodiment, a base 10 is fastened to the cover's casing 9 by means of rods 91*a* and 92*a* received in openings 91 respectively 92 enabling the cover to be assembled with the clasp's second arm 8, respectively with the bracelet's second portion. The rod 91*a* is received in openings 91 and traverses an extremity of the casing, the holes 102 in the base and the opening 81 in the second arm 8. The other rod 92*a* is received in the opening 92 and traverses the casing's other extremity, the holes 101 in the base and the two links (not represented) of the first row of the second portion. This variant embodiment thus does not use any screws, which are always at risk of becoming unscrewed. On the other hand, the base 10 cannot be made from a simple plate but must be manufactured by detach cutting machining, molding or stamping with a non-plane stamp or die, which renders it more expensive. Furthermore, the machining tolerance must be accurate in order to prevent the base from lifting off and allowing the locking system 5 to come out when the rod 91 is removed in order to modify the bracelet's length. The cover further features openings 90 for the push-pieces, an internal volume 95 and slits 100.

In this variant embodiment, the casing 9 also determines the aesthetic appearance of the closed clasp. It thus also presents sides 94, 96, 98 of uneven thickness according to the desired design.

It will be understood that the inventive bracelet is characterized first and foremost by the particular structure of the clasp's cover. This cover can however also be used with clasps of other types, notably clasps having three arms of the wallet or butterfly type, or clasps allowing the length to be adjusted.

The invention claimed is:

1. Bracelet provided with a foldable clasp, comprising:

a first arm having first and second extremities, at least a second arm having first and second extremities articulated with said first arm at the first extremity of said first arm, a cover, the second extremity of the first arm being articulated with a first portion of the bracelet, the second extremity of the second arm being articulated with said cover, said cover being articulated with a second portion of the bracelet, in such a way that said cover and said second portion of the bracelet can rotate relative to each other when the cover is closed in order to adapt to a variety of bending radii of wearer's wrist, said cover comprising a locking system enabling the first and second arms to be held in closed position and to be released by acting manually on said locking system to open said clasp, said cover comprising a casing having two lateral sides and one upper side connecting said lateral sides and a base closing said cover, said sides of the casing defining between them and with the base an internal volume in which said locking system is at least partially accommodated, said sides of said casing are solid and the lateral sides are of uneven thickness with respect to said upper side, and in that the free extremities of said arms are folded back under said cover when the clasp is closed, said base being fastened to said casing by means of rods, said rods enabling said base and said casing to be assembled with the clasps second arm, respectively with the bracelet's second portion.

2. Bracelet according to claim 1, wherein said locking system comprises:

at least one holding means for holding said arms against one another in folded position when said holding means is in closed position, at least one elastic means for forcing the holding means into closed position, at least one push-piece for acting against the force of the elastic means and release the holding means by pressing on the push-piece.

3. Bracelet according to claim 2, wherein said base further comprises at least one opening, said holding means being guided by the edges of said opening between the closed position and the released position of the clasp.

4. Bracelet according to claim 2, comprising two push-pieces, said holding means being released only when said two push-pieces are actuated separately.

5. Bracelet according to claim 2, wherein said elastic means comprise at least one extensible rod, each of whose two extremities are lodged in a recess in two distinct push-pieces, said at least one holding means comprising two hooks, each being integral to one of said push-pieces and hooking in said closed position at least one of said arms.

6. Bracelet according to claim 5, said elastic means comprising two rods parallel to one another.

7. Bracelet according to claim 1, wherein said locking system engages the first arm on each side of the second arm.

8. Bracelet according to claim 1, said base being removably fastened to said casing.

9. Bracelet according to claim 8, said base comprising a tongue preventing the base from becoming disunited from said casing when said clasp is in closed position, even if said base is unscrewed.

10. Bracelet according to claim 8, said base being screwed onto said casing by means of screws visible only on the lower side of said cover.

11. Bracelet according to claim 1, said base being formed from a plate of even thickness.

12. Bracelet according to claim 1, said portions each comprising several links, the profile of said casing's lateral sides being the same as the profile of the lateral sides of said links.

13. Bracelet according to claim 12, said portions each comprising several rows of links, the width and surface conditioning of said clasp being the same as those of said bracelet's rows of links.

14. Bracelet provided with a foldable clasp, comprising:

a first arm having first and second extremities, at least a second arm having first and second extremities articulated with said first arm at the first extremity of said first arm, a cover, the second extremity of the first arm being articulated with a first portion of the bracelet, the second extremity of the second arm being articulated with said cover, said cover being connected to a second portion of the bracelet, said cover comprising a locking system enabling the first and second arms to be held in closed position and to be released by acting manually on said locking system to open said clasp, said cover comprising a casing having two lateral sides and one upper side connecting said lateral sides and a base closing said cover, said sides of the casing defining between them and with the base an internal volume in which said locking system is at least partially accommodated, said lateral and upper sides of said casing are solid and the lateral sides are of uneven thickness with respect to said upper side, the free extremities of said arms being folded back under said cover when the clasp is closed, said locking system comprising at least one holding means for holding said arms against one another in folded position when said holding means is in closed position, at least one elastic means for forcing the holding means into closed position, and at least one push-piece for acting against the force of the elastic means and release the holding means by pressing on the push-piece, wherein said elastic means comprise at least one extendable rod, each of whose two extremities are lodged in a recess in two distinct push-pieces, said at least one holding means comprising two hooks, each being integral to one of said push-pieces and hooking in said closed position at least one of said arms.

15. Bracelet according to claim 14 wherein said elastic means comprises two rods parallel to one another.

16. Bracelet provided with a foldable clasp, comprising:

a first arm having first and second extremities, at least a second arm having first and second extremities articulated with said first arm at the first extremity of said first arm, a cover, the second extremity of the first arm being articulated with a first portion of the bracelet, the second extremity of the second arm being articulated with said cover, said cover being connected to a second portion of the bracelet, said cover comprising a locking system enabling the first and second arms to be held in closed position and to be released by acting manually on said locking system to open said clasp, said cover comprising a casing having two lateral sides and a base closing said cover, said sides of the casing defining between them and with the base an internal volume in which said locking system is at least partially accommodated, said locking system comprising two distinct push-pieces, each push-piece having a blind hole, both push-pieces are connected via at least one rod lodged in said blind hole, said locking system further comprising one elastically extensible element having two extremities lodged between the end of said at least one rod and the end of the blind hole so as to force the locking system into closed position.

17. Bracelet provided with a foldable clasp, comprising:

a first arm having first and second extremities, at least a second arm having first and second extremities articulated with said first arm at the first extremity of said first arm, a cover, the second extremity of the first arm being articulated with a first portion of the bracelet, the second extremity of the second arm being articulated with said cover, said cover being connected to a second portion of the bracelet, said cover comprising a locking system enabling the first and second arms to be held in closed position and to be released by acting manually on said locking system to open said clasp, said locking system comprising two distinct push-pieces, each push-piece having a recess, said locking system further comprising one elastically extensible element for urging said push-pieces outside of said cover and to force the locking system into closed position, said elastically extensible element being constituted by one spring in each of said recesses, and a rod partially engaged in two recesses of the two push pieces.

* * * * *